US005230515A

United States Patent [19]

Cohen

[11] Patent Number: 5,230,515

[45] Date of Patent: Jul. 27, 1993

[54] WORD FORMING BOARD GAME INCLUDING ELEMENTS OF CONFLICT

[76] Inventor: Gene D. Cohen, 1915 Biltmore St. N.W., Washington, D.C. 20009

[21] Appl. No.: 981,121

[22] Filed: Nov. 24, 1992

[51] Int. Cl.[5] ..... A63F 3/02

[52] U.S. Cl. ..... 273/261; 273/272

[58] Field of Search ..... 273/243, 248, 249, 260, 273/261, 272, 299; 434/128, 159, 167

[56] References Cited

U.S. PATENT DOCUMENTS

| | | | |
|---|---|---|---|
| 1,576,619 | 3/1926 | Reubin | 273/260 X |
| 1,633,887 | 6/1927 | Espitallier | 273/260 X |
| 2,453,907 | 11/1948 | Hare et al. | 273/260 X |
| 3,624,808 | 11/1971 | Anderson | 273/272 X |
| 3,869,124 | 3/1975 | Stein et al. | 273/260 X |
| 4,055,347 | 10/1977 | Kreischer | 273/272 X |
| 4,201,389 | 5/1980 | Vowell | 273/272 |
| 4,289,314 | 9/1981 | Berlino | 273/260 |
| 4,365,813 | 12/1982 | Hirsch . | |
| 4,572,514 | 2/1986 | Aponte . | |
| 4,601,473 | 7/1986 | Dubren et al. | 273/272 |
| 4,741,538 | 5/1988 | Lewis | 273/243 |
| 5,011,159 | 4/1991 | Fortunato et al. . | |
| 5,026,069 | 6/1991 | Leask . | |

FOREIGN PATENT DOCUMENTS

| | | | |
|---|---|---|---|
| 885340 | 12/1961 | United Kingdom | 273/272 |
| 1522794 | 8/1978 | United Kingdom | 273/272 |
| 2070446 | 9/1981 | United Kingdom . | |
| 2227674 | 8/1990 | United Kingdom . | |

*Primary Examiner*—William Stoll
*Attorney, Agent, or Firm*—Richard C. Litman

[57] ABSTRACT

A board game for two players or teams includes elements of the games of scrabble and chess as well as other novel features, and includes a game board having a pattern of lettered playing spaces and a plurality of differently configured playing pieces or markers for each player or team. The differently configured playing pieces or markers are assigned patterns for their moves on the board depending upon their configuration. The pieces/markers are alternatingly moved to various lettered spaces on the board to claim letters for use in forming words. Points are awarded for each letter used in the formation of a word. A further aspect of the game is that no markers or pieces are ever captured or removed from play, even though the rules allow two opposing pieces to occupy the same space under certain circumstances. Other rules provide for skipping a turn or skipping the use of a letter under certain circumstances, and for the doubling or tripling of the point value for a letter when a marker is moved to a space already occupied by an opposing player's marker, depending upon the rank of the opposing marker. The configuration of some of the markers provides for the vertical stacking of two of those markers on the same space of the board.

12 Claims, 5 Drawing Sheets

WORD FORMING BOARD GAME INCLUDING ELEMENTS OF CONFLICT

FIELD OF THE INVENTION

The present invention relates generally to board games, and more specifically to a board game in which words are formed by movement of playing pieces, and which combines elements of the games of chess, checkers and Scrabble (TM) or a crossword puzzle.

BACKGROUND OF THE INVENTION

Crossword puzzles, word games, etc. are extremely popular pastimes for many individuals, particularly those confined to a relatively sedentary lifestyle or who suffer from various physical handicaps and are unable to engage in more physical activities. Many, if not most, such persons possess relatively clear and sharp minds and enjoy the mental challenge which accompanies such games and puzzles.

While such word games and puzzles may respond to the need for mental stimulation, they provide little in the way of a struggle or conflict, either actual or stimulated. Indeed, such pursuits as crossword puzzles are almost universally enjoyed by a single individual and no provision for competition is made. Even such games as Scrabble, while providing competitive aspects, fail to provide the elements of conflict offered by military or quasi-military games such as chess.

The need arises for a word forming game which serves to stimulate the associated mental processes, and which simultaneously provides elements of conflict and competition between two or more players. The game should incorporate various playing pieces capable of different moves, and provide other rules for engaging in conflict between opposing pieces, while at the same time rewarding players capable of forming words according to the rules.

DESCRIPTION OF THE PRIOR ART

U.S. Pat. No. 4,289,314 issued to Gary M. Berlino on Sep. 15, 1981 discloses a Word Forming Checkers Game Method. The game includes an elongated checker board and a plurality of playing pieces comprising lettered cubes. The cubes are moved in accordance with the rules for checkers and the various faces of each cube are turned upward as desired to form various words during the course of play. The unlettered board and limited variety of moves of the lettered playing pieces provide a game lacking the complexity of the game of the present invention.

U.S. Pat. No. 4,365,813 issued to Ernest Hirsch on Dec. 28, 1982 discloses a Word Game using a linear board for the placement of lettered playing pieces, the pieces having various values. While the Hirsch patent provides a game similar to a simplified version of the well known game of Scrabble, a chance element is added to change the value of the playing pieces and words formed therewith. The present game is one of pure skill, unlike the Hirsch game, and does not incorporate any chance means.

U.S. Pat. No. 4,572,514 issued to Guillermo Aponte on Feb. 25, 1986 discloses a Military Board Game including a rectangular game board upon which pieces representing military weapons may move. The pieces are all subject to like moves, and chance means are included in the game, unlike the present game.

U.S. Pat. No. 5,011,159 issued to Michael Fortunato et al. on Apr. 30, 1991 discloses a Method Of Playing A Chess Game. The rules of the well known game of chess are exactly described as a part of the game, but dice are used to dictate which pieces are moved. Provision is made for play by one, two or more players, and provision is also made for monetary reward. The lack of the use of any alphabetic letters or word forming, and the element of chance included, render the Fortunato et al. game unlike the game of the present invention.

U.S. Pat. No. 5,026,069 issued to Harold J. Leask on Jan. 25, 1991 discloses a Method Of Playing A Battle Strategy Game using an open board. The board provides few limits as to the position or movement of the playing pieces, which pieces are moved entirely according to a tricolored die. No alphabetic letters are used for scoring or other aspects of the game.

U.K. Patent No. 2,070,446 to Michael J. Taylor and published on Sep. 9, 1981 discloses a War Board Game which is played essentially according to the rules of chess, with a few minor modifications. Additional playing pieces are used to add to the complexity of the game. The game board may be a conventional eight by eight chess board, or hexagonal in form. No alphabetic letters or word forming is used in the play of the game.

Finally, U.K. Patent No. 2,227,674 to Christopher J. Cunningham and published on Aug. 8, 1990 discloses a Word Game having rules governing the formation of only one of two specific words. No letters are formed on the board itself, but rather are marked upon a relatively small number of specific playing pieces which are moved according to rules somewhat similar to those governing the movement of chess pieces in the game of chess. The limited number of words which may be formed and the lack of alphabetic letters on the board itself, render the Cunningham game unlike the game of the present invention.

None of the above noted patents, taken either singly or in combination, are seen to disclose the specific arrangement of concepts disclosed by the present invention.

SUMMARY OF THE INVENTION

By the present invention, an improved board game is disclosed.

Accordingly, one of the objects of the present invention is to provide a board game which provides for the formation of words by means of the movement of playing pieces over a lettered board.

Another of the objects of the present invention is to provide a board game which includes a plurality of different types of playing pieces, each type limited to a certain specific pattern of movement.

Yet another of the objects of the present invention is to provide a board game which may be played by two teams each comprising one or more players.

Still another of the objects of the present invention is to provide a board game in which two opposing playing pieces may occupy the same square of the board under certain circumstances.

Another object of the present invention is to provide a board game in which two opposing playing pieces may be vertically stacked one atop another when occupying the same space.

And another object of the present invention is to provide a board game in which two opposing playing pieces may be fitted together laterally to occupy the same space on the board.

A further object of the present invention is to provide a board game in which a plurality of playing position pieces may be used to accomplish a single objective, i.e., form a single word.

An additional object of the present invention is to provide a board game incorporating a game board having a thirteen by thirteen matrix of spaces containing the letters of the Roman alphabet and totaling 169 spaces.

Another object of the present invention is to provide a board game which includes provisions for less skilled players and other options.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
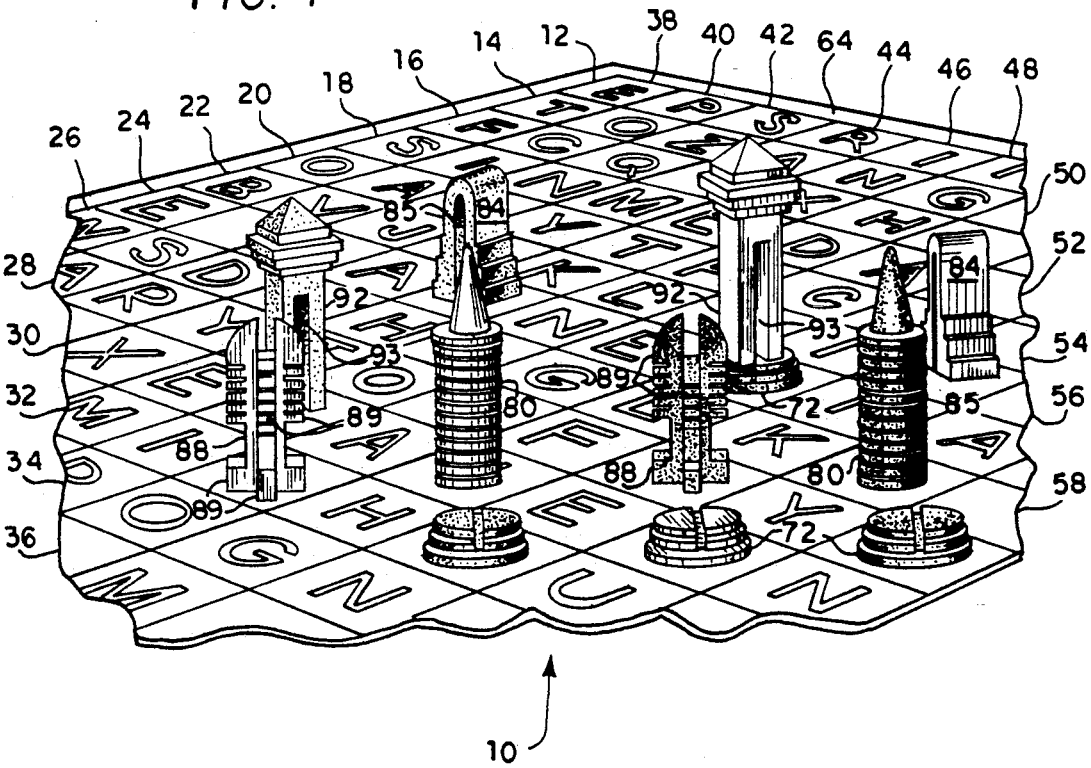
FIG. 1 is a fragmented perspective view of a portion of the game board of the present invention and a plurality of playing pieces disposed thereon.

Referring now to the drawings, the present invention will be seen to relate to a board game providing for the formation of words and also including elements of conflict in the play of the game. FIG. 1 provides a view of a portion of the game board 10 as well as the various playing pieces used in the play of the present game. These pieces and the specific moves allowed by each specific type of piece will be described further below.

Figure 2:
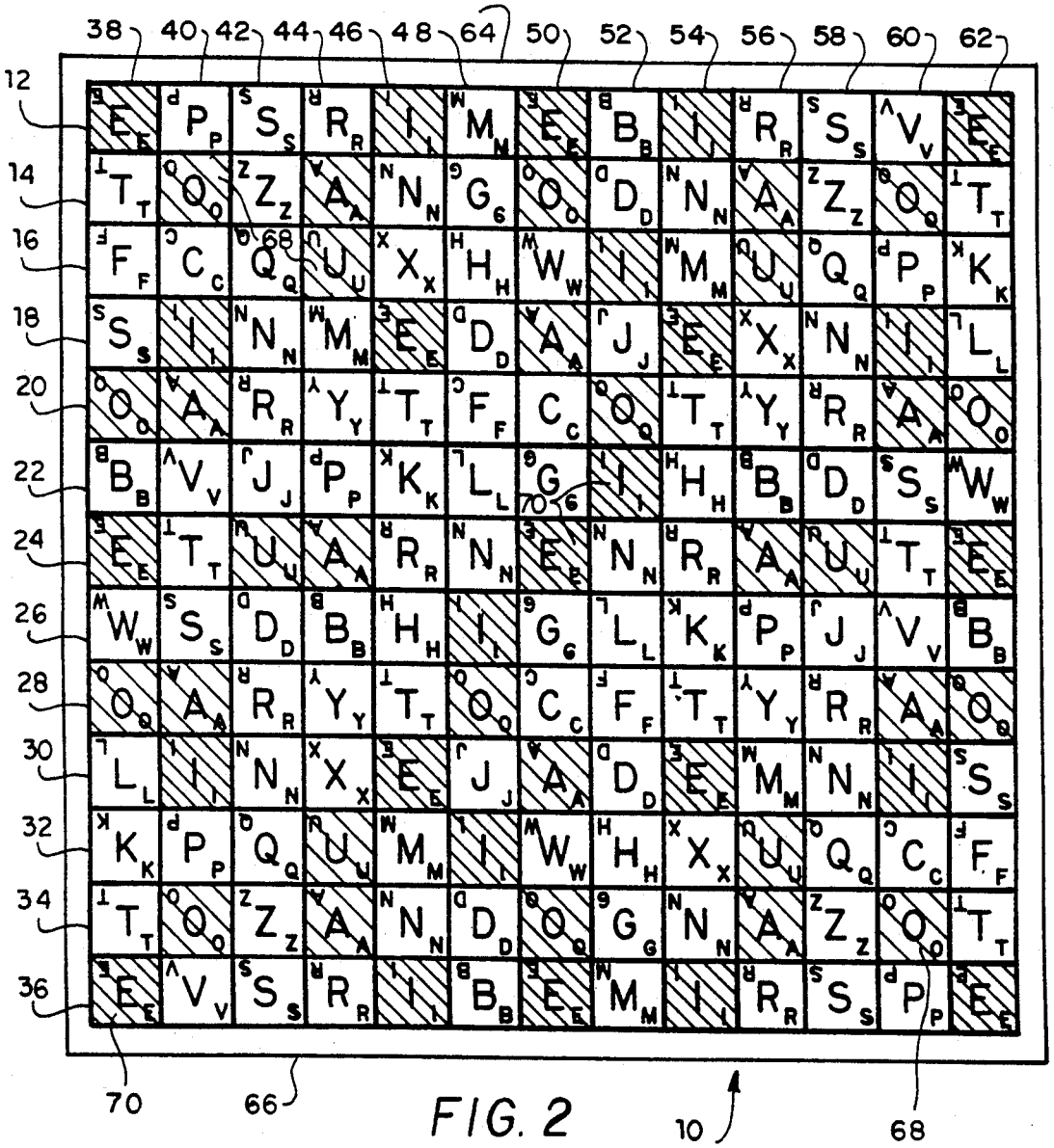
FIG. 2 is a plan view of the game board of the present invention.

FIG. 2 is a plan view of the game board 10, showing the layout of the board 10 and its various features and details. Board 10 is generally rectangular in form, or more specifically may be square, and is preferably divided into 13 horizontal rows 12 through 36 and 13 vertical columns 38 through 62. The 13 by 13 matrix of rows and columns will be seen to result in 169 squares, each of which may be described by means of its unique row number and column number. This system (e.g., 12/38 for the upper left square of the board 10, in which the letter E appears) will be used throughout the balance of the present specification as needed to describe specific features of the board 10.

Each of the 169 squares of the board 10 contains a letter of the Roman alphabet. The center of each of the squares will be seen to contain an upper case block letter, with smaller oppositely facing upper case block letters at two diagonally opposite corners. The corner letters assist players of the game in determining the letter of a particular square when a playing piece is positioned thereon, and further assist any player(s) who may be situated facing the top edge 64 (i.e., the edge closest to row 12) of the board 10 to read the board, as one of the smaller corner letters in each square is inverted relative to the other two letters.

The distribution of the letters on the board is symmetrical, with the same arrangement appearing on opposite sides of the board when viewed from left to right by a player on that side of the board. Thus, the order and arrangement of the letters of the board 10 will be the same whether a player is facing the top edge 64 or the bottom edge 66 (the edge closest to row 36) of board 10.

Preferably, at least some of the squares of board 10 are distinctively marked or shaded for contrast and to aid the player (s) in generally orienting themselves relatively rapidly. In the case of board 10 of FIG. 2, each of the vowels have been shaded, thus enabling them to be picked out rapidly by a player or players. Preferably, the vowels are shaded in green, in keeping with the somewhat military theme of the game. The vowels A, O, and U are colored or shaded in a lighter green, as indicated by the relatively wide spacing of the shading lines 68, e.g. squares 14/40, 14/44, and 16/44, while the vowels E and I are shaded in a darker olive green, as exemplified by the shading 70 at squares 12/38 and 12/46. The remainder of the board comprising the consonants may be left in a natural finish or shaded as desired, e.g. in a metallic color or shading to further provide a quasi-military "feel" for the game board 10. Other shadings, colors and pattern are of course possible without departing from the spirit of the present game and rules of play discussed further below. For example, the various vowels may be differently colored rather than being colored with different shades of the same color, or may all have the same color in order to make them distinct from the consonants. Further, the consonants may be colored and/or shaded as desired, or the entire board may have a uniform color with the exception of the markings designating the different spaces of the board and the letters of the alphabet thereon.

Figure 3:
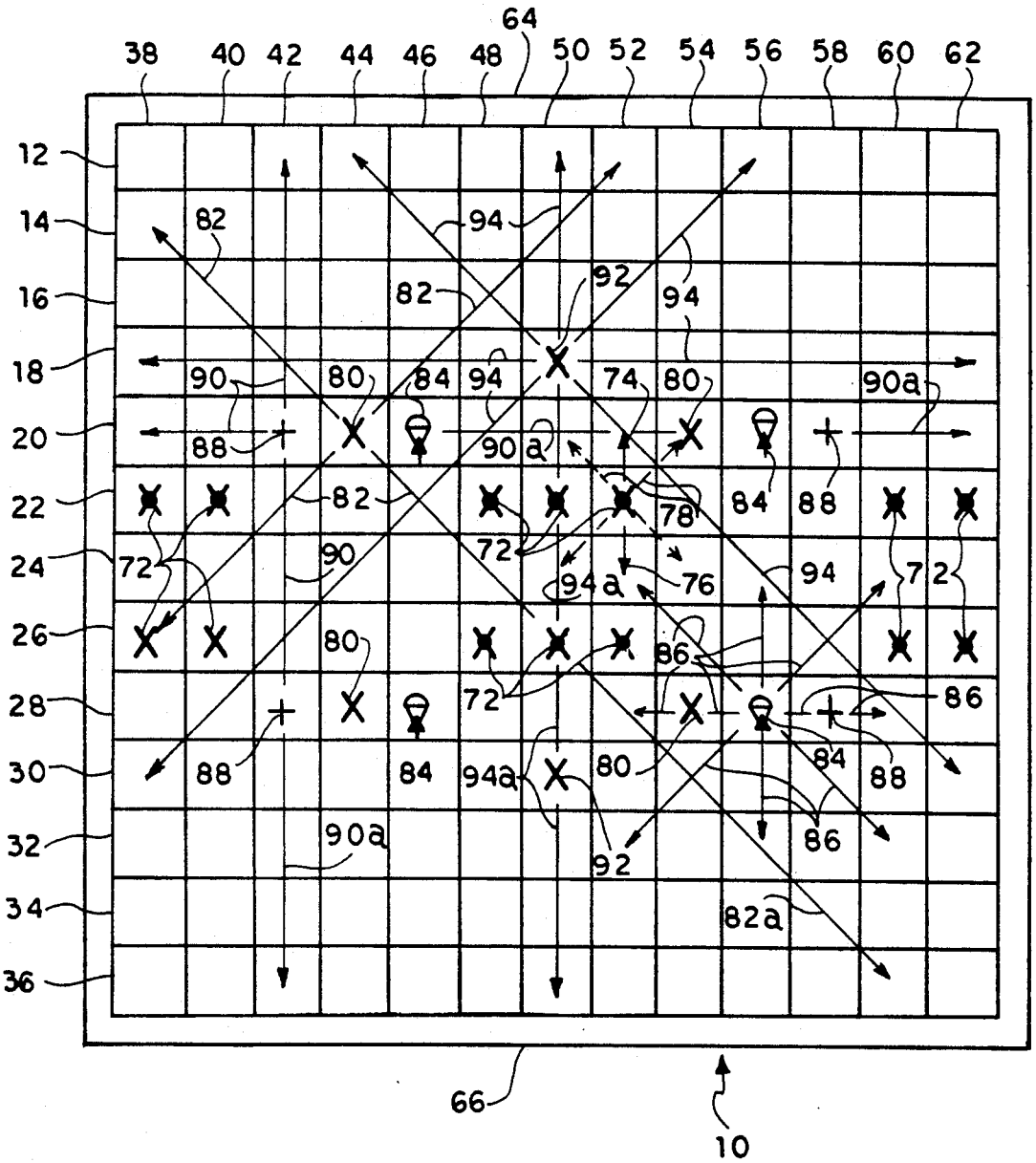
FIG. 3 is a plan view of the thirteen by thirteen matrix of the game board with the lettering omitted, showing the symbols representing the various playing pieces, their starting positions for the beginning of a game, and their directions of movement.

FIG. 3 shows a simplified version of board 10, in which the various letters have been omitted for clarity. FIG. 3 also discloses the symbols for the various playing pieces, their positions for the start of a game, and the directions and general magnitudes of their moves. The callouts for the board 10 of FIG. 3 are identical to those for the board 10 shown in FIGS. 1 and 2, the only difference being the omission of the letters on the board of FIG. 3 in order to show the arrangement and movement of the playing pieces more clearly.

Each player commands five different types of playing pieces, with each of the five different types having a different rule governing its range of movement on the board 10. (It will be understood that the term "player" may include one or more individuals, which individuals commanding the playing pieces of one side serve to form a team. The term "player" will hereafter also include a team formed of more than a single player.) The playing pieces are arranged upon board 10 as indicated in FIG. 3 at the start of a game, with a first player's pieces place rows 26, 28 and 30 and a second player's pieces placed upon rows 22, 20 and 18 of board 10. Thus, a central empty row 24 will lie between the two opposing sets of playing pieces. The two groups of playing pieces comprising the pieces for a first player and a second player are preferably differently colored or shaded, in order for the two opposing players to distinguish their pieces from one another. Preferably, the pieces or markers of the first player are black, while the pieces or markers of the second player are silver. Of course, other colors, shading or markings may be used without departing from the scope of the game of the present invention.

The most numerous type of playing piece is arranged along row 26 for the first player, and along row 22 for the second player. Each player commands seven of these players pieces. These pieces 72 are known as "infantry" and are initially specifically placed upon squares 26/38, 26/40, 26/48, 26/50, 26/52, 26/60, and 26/62 for the first player, and upon squares 22/38, 22/40, 22/48, 22/50, 22/52, 22/60, and 22/62 for the second player. Infantry pieces or markers 72 are symoblized by a narrow rectangle having four short diagonal lines extending therefrom, thus somewhat symoblizing the movement allowed for such pieces 72. Actual infantry playing pieces or markers 72 are indicated by the same numeral in FIG. 1. Infantry pieces are restricted to forward or rearward movement (i.e., either toward the top edge 64 or bottom edge 66 of board 10, for a first player) and may only move one square per move, as indicated by the infantry marker 72 at square 22/52 and the forward and rearward movement arrows 74 and 76 extending therefrom. An exception to the above occurs when an infantry piece 72 may move one space diagonally (either forward or rearward) to occupy a space already occupied by an opposing player's marker or piece, as indicated by the broken arrows 78 extending one square diagonally from the infantry marker 72 of square 22/52. When a first player's marker or piece moves to simultaneously occupy a square already occupied by a second player's marker or piece, it is known as "engaging in conflict" and will be explained further below. (The specific arrangement of pieces shown on board 10 of FIG. 3 does not permit such a diagonal move, as no opposing pieces are within one diagonal square of any infantry piece 72 in th arrangement of pieces for starting the game. However the move is explained, as it may occur during the course of the game.)

The above rules governing the movement of the infantry pieces 72 will be seen to be somewhat similar to the movement of pawns in the game of chess. Other similarilies exist, such as the generally wider range of moves permitted to the higher ranking pieces discussed further below. The relative values of the two classes of pieces (the infantry pieces 72 and the "special forces" pieces comprising all other types) enter into the scoring of the game, as will be discussed further below.

The first of the "special forces" pieces or markers to be discussed is the cavalry marker 80, symbolized by the X of squares 28/44 and 28/54 for the first player and 20/44 and 20/54 for the second player. The same callout 80 is used to indicate such cavalry markers or pieces 80 in FIG. 1 also. The X symbol is used to indicate the nature of the purely diagonal moves which the cavalry markers 80 may make. The magnitude of the moves is limited only by any other playing pieces which might lie along a given diagonal, and by the edges of the board. Diagonal arrows 82 extending from the second player's cavalry marker 80 located at square 20/44 indicate the range of movement possible by that marker 80 at that position 20/44. (It wil be noted that a first player's infantry piece 72 is situated on square 26/50, along the lower right diagonal extending from the cavalry piece or marker 80 of square 20/44. If this were the case in an actual game, the marker 80 would be unable to move past the opposing player's infantry piece 72 on square 26/50. No playing piece may move beyond a square blocked by another playing piece, with the exception of the rules governing the movement of paratrooper playing pieces 84 and "engaging in conflict" to be discussed below. The extended lower right diagonal arrow **82*a* is intended to show the potential range of movement of the cavalry piece 80 starting from square 20/44** if there were no other pieces interposed along that diagonal path.)

The above description of movement for a cavalry piece 80 will be seen to be identical to that for a chess bishop, and in fact identical restrictions apply. For example, a single cavalry piece 80 may only reach a potential of approximately half the squares on the board. This may be seen by visualizing a chess or checkerboard having the customary alternating colored diagonal pattern, and noting that a playing piece situated on a square of any given color and moving diagonally, may only reach squares of like color. Accordingly, each player controls two cavalry markers 80, initially positioned so as to be collectively capable of reaching all of the squares of board 10.

A parachute and arrow symbol is used for the paratrooper marker or pieces 84, situated on squares 28/46 and 28/56 for the first player and squares 20/46 and 20/56 for the second player. Again, a like numeral 84 is used to indicate actual paratrooper pieces 84 used in the play of the game as shown in FIG. 1. Paratrooper markers or pieces 84 may move in any direction, but the magnitude of the move is limited to two squares. Arrows 86 radiating from the paratrooper symbol 84 positioned on square 28/56 indicate the range of such movement. Paratrooper playing pieces 84 are the single exception to the rule that no pieces may jump over another; paratrooper markers or pieces 84 may jump or cross over other playing pieces, either of the same or opposing sides. The only time a paratrooper 84 is not allowed to jump an occupied square is when two opposing pieces are already occupying that square, i.e., "engaging in conflict." The moves permitted to paratrooper markers or pieces 84 will be seen to be somewhat reminiscent of those permitted to a knight in the game of chess.

Each player's pieces also include two scouts 88, situated at the beginning of a game on squares 28/42 and 28/58 for the first player and on squares 20/42 and 20/58 for the second player as shown in FIG. 3. Scouts 88 are indicated by "+" symbols in FIG. 3, indicating their range of movement along the rows and columns of board 10. The magnitude of their movement is indicated by the arrows 90 extending forwardly and rearwardly from the scout marker 88 of square 20/42 respectively toward the upper and lower edges 64 and 66 of board 10 of FIG. 3, and laterally from that scout marker 88. As a scout piece 88 may not jump any other pieces, the actual movement of a scout piece 88 initially positioned on square 20/42 of FIG. 3 could not extend laterally to the right beyond the adjacent square 20/44 already occupied by a cavalry piece 80 or downward beyond square 28/42 occupied by an opposing scout piece 88. However, arrows **90*a* have been provided to indicate the full range of movement allowed a scout marker or piece 88 in the event no interposing pieces were so positioned. The movement for scout markers or pieces 88 described above will be seem to be essentially identical to that of a rook in the game of chess. Actual scout game pieces using the same numerical callout 88 are so indicated in the perspective view of the game shown in FIG. 1**.

Finally, each player commands one additional playing piece 92, called the "General." These two pieces 92 (one for the first player and one for the second player) are indicated in FIG. 1 and also symbolized by the "*" mark at squares 30/50 (first player's general) and 18/50 (second player's general) and are indicated in FIG. 1 by the callout 92. The symbol used to indicate the starting positions for the two general markers 92 also serves as a mnemonic device to indicate the range of potential movement of a general marker 92. The movement of these general markers 92 is the same as that for the queen in chess, i.e., movement in any forward, rearward, lateral or diagonal direction is permitted with the magnitude limited only by the boundaries of the playing board and any intervening playing pieces. The arrows 94 radiating from the general marker 92 positioned at square 18/50 of board 10, FIG. 3, indicate the possible movement of that marker or piece 92 from that particular square. Again, the piece cannot jump or pass through a square on which another playing piece (either friendly or opponent) is situated. The portions of arrow 94*a* extending downward toward the bottom edge 66 of board 10, FIG. 3, indicate the potential movement of the general marker 92 at square 18/50 if there were no other pieces interposed.

The object of the present game is to score points by means of maneuvering the playing pieces 72, 80, 84, 88, and 92 described above on a board 10 containing letters as shown in FIG. 2, to form words from those letters. Points are awarded to players successfully forming words according to the rules of the present game. The player first accumulating a previously agreed upon number of points (e.g., 350) is the winner. Alternatively, a greater or lesser number of points may be used as a winning score, depending upon the skill of the players, the time available, etc. In the event a specific time period is provided (a lunch hour, etc.) players may play to a predetermined elapsed or chronological time if desired, with the player having the most points at that time being the winner. A scoresheet 96 is provided in FIG. 4, and will be discussed further in accordance with the example of play described immediately following and generally shown in the block diagram and flow chart of FIG. 5.

Before the beginning of a game, a first and second player (which may include first and second teams, as discussed above) are determined for the two sides of play. The method used may be as in chess, where one of two opposing pieces of different colors is blindly chosen by a player, or other means (mutual agreement, coin toss, etc.) may be used. A general convention of the present game is that the player using the black pieces will always move first, but of course this may be modified according to the wishes of the players. This is generally described in step 1 of FIG. 5.

The playing pieces or markers for the two opposing players or sides are positioned on the board for the start of the game as described above and as shown in FIG. 3. The player commanding the black (or other color as agreed upon or provided) moves any playing piece or marker 72, 80, 84, 88, or 92 of his/her choice, with the immediate goal being to land that marker or piece on a letter of the board 10 which may be used as the first letter of a word, as generally described in step 2 of FIG. 5. (Letters upon which a piece is currently located may not be used for the formation of words; the playing piece must actually be moved in accordance with the rules of the game in order to claim a letter and use that letter in the formation of a word.) Obviously, it is best not to inform the opposing player of the word which a player is attempting to form. To do so would provide the opposing player with knowledge of the letters required for the word, and thus provide the opposing player with opportunities to block the paths of the playing pieces of the other player in an attempt to prevent the other player from forming the desired word.

Figure 5:
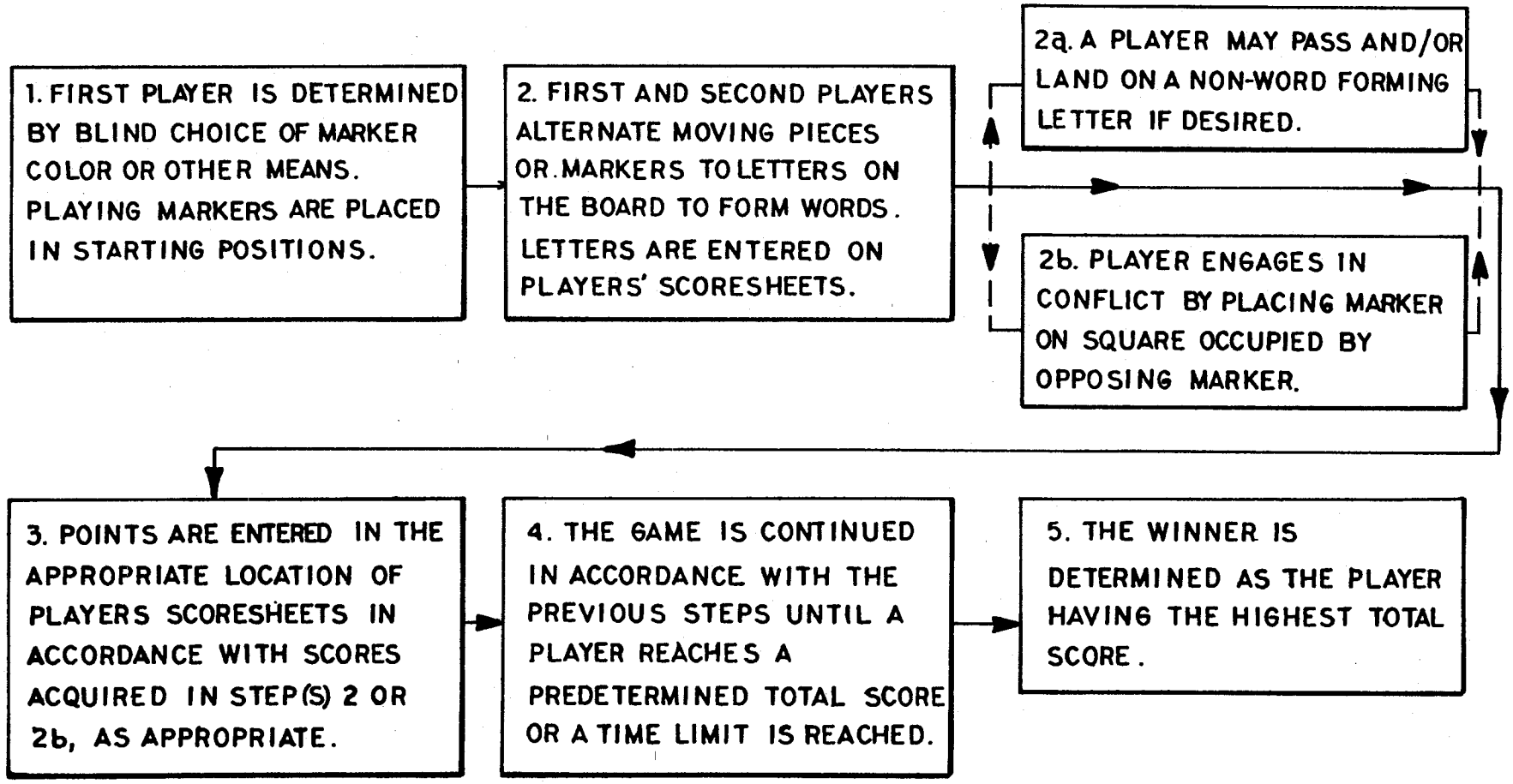
FIG. 5 is a flow chart showing the steps involved in the method of play of the present game.

After the first player has completed his/her move and assuming that player wishes to use the letter to which the marker moved in the formation of a word, that letter is entered in the first space of the "letters" row 98 provided on his/her scoresheet 96, as noted in FIG. 5, step 2. (Each player/team will have his/her own scoresheet 96.) A player may skip a turn or move a marker to a letter not used to form a word, if desired; appropriate notation (e.g., "pound" or other symbol) may be used on the scoresheet 96 to keep track of such occurrences. However, the preferred rules allow only two such consecutive non-word forming moves or passed turns before a turn must be taken and the next letter landed upon must be used. Further, in order to keep the pace of the game moving, this rule may be modified to allow only one pass or non-word forming move after a predetermined number of letters (e.g., 5) have been entered on the scoresheet. This rule may of course be modified as desired by the players. Optional step 2*a* of FIG. 5 describes this procedure. In the event a word is partially formed and the player fails to continue the formation of the word within the appropriate number of turns, that player loses all letters formed up to that point and must begin anew with the acquisition of a first letter to form that or another word. Accordingly, it is important to maintain a record of passed turns or non-word forming turns as noted above.

Figure 4:
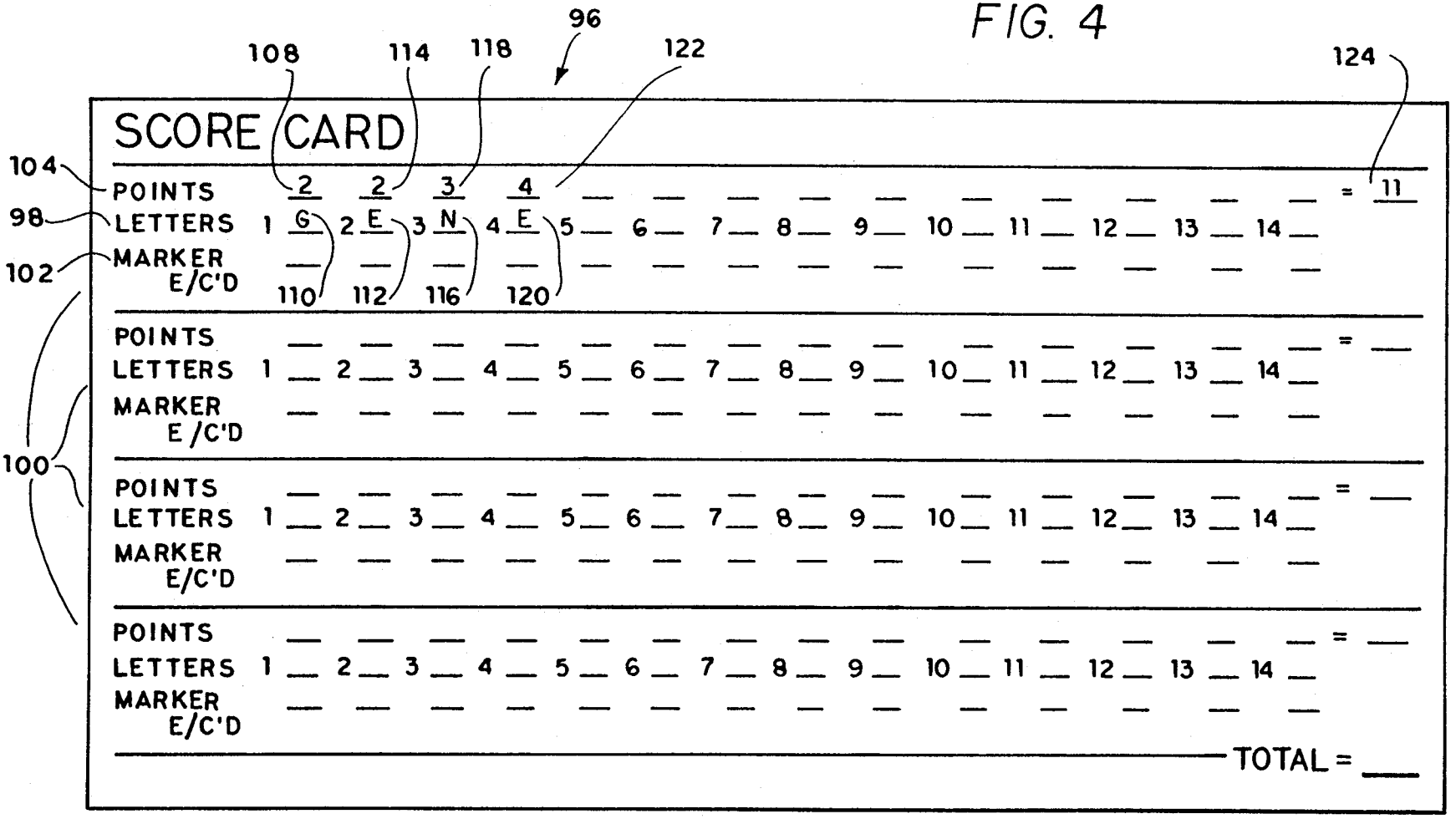
FIG. 4 is a view of a score sheet for the present game.

The scoresheet 96 of FIG. 4 will be seen to provide up to fourteen spaces for letters per each row 100. In the event a word longer than fourteen letters is formed, the word may be continued on the next row down. A new row 100 is used for each new word, due to the scoring system which will be discussed further below. The fourteen spaces of each row 100 of scoresheet 98 provide for the formation of the longest generally accepted word in the English language ("antidisestablishmentarianism"), which contains 28 letters, thus exactly filling two rows 100 of scoresheet 96. Letters entered on the scoresheet 96 to form words are awarded points on an arithmetically increasing scale, with the first letter worth one point and each subsequent letter worth one more point than the preceding letter. Thus, a five letter word would be worth $1+2+3+4+5$ points, $=15$ points according to the basic scoring system.

However, other means of increasing a player's score are provided by variations in the rules of the present game. For example, it is possible that a first player may wish to use a letter of a square upon which one of the markers or pieces of the second player is resting. It is permissible for the first player to move one of his/her markers to the same position already occupied by a marker controlled by the second player, if the first player uses the letter of that square in the formation of a word (and vice versa). This is called "engaging in conflict," and in fact is desirable as it increases the points accrued by using that letter. This procedure is generally described in step 2*b* of FIG. 5. The specific physical configuration of the various types of pieces or markers as shown in FIG. 1 permits the vertical stacking of different types of pieces one atop another, in order to preclude the obscuring of the diagonal corner letters of that square. An example of this vertical stacking is shown by the "general" marker 92 engaged in conflict with and stacked atop an opposing "infantry" marker 72 on the "N" square 24/52 of FIG. 1.

Other playing pieces include provision for lateral interfit in order to provide for two playing pieces on a single space. For example, the general X shape of the "scout" markers 88 will be seen to provide a plurality of vertically arrayed lateral extensions 89, which extensions 89 may cooperate with vertical slots 85 of paratrooper pieces 84 and vertical slots 93 of general pieces 92. Thus, if a scout marker 88 engages in conflict with a paratrooper marker 84, the two markers 84 and 88 may be temporarily assembled together by inserting one of the extensions 89 of the scout marker 88 into the cooperation slot 85 of the paratrooper maker 84 in order to conserve space on the particular space of board 10 upon which they are engaged. The same provision applies when a scout 88 is engaged in conflict with a general 92, in which case one of the extensions 89 of the scout marker 88 is laterally installed within the slot 93 of the respective general marker 92.

The rules for engaging in conflict do not permit more than two pieces on a single square at one time, nor does the placement of one piece upon another or laterally interfit with another necessarily have any significance as to the score resulting from the move. The stacking and lateral interfitting configurations merely provide a broader view of the board for the players.

As discussed above, the pieces or markers may be classified in two general categories: Infantry pieces or markers and Special Forces pieces/markers. While any of these pieces may engage in conflict with any of the opposing pieces or markers, the scoring is affected depending upon the classification of the opposing pieces engaging in conflict on a given square. The variation in scoring is dependent upon both the sequence of the letter in the word being formed (the more letters acquired to that point, the greater the value of the next letter) and also on whether the opposing piece already occupying the square is an infantry piece or a special forces (cavalry, scout, paratrooper or general) piece or marker. The "attacking" piece (i. e., the piece being moved to the occupied square) has no bearing on the above; only the status of the occupying piece affects the value of the letter thus acquired. If an infantry marker or piece is occupying the square, the value of the letter acquired by the attacking piece is doubled. If the occupying marker is of special forces classification, the value is tripled for that given letter.

As an example, assuming a first player wishes to acquire the fourth letter in a series used to form a word, he/she may do so by moving one of his/her markers (either infantry or special forces) to a square already occupied by a special forces marker of the opposition. Normally, the first player would receive four points for the acquisition of the fourth letter of the word, and this score would be entered in the fourth space of one of the columns 100 of scoresheet 96. However, as the score for that letter is triple due to the engagement in conflict with an opposing special forces marker already on that square, the first player would receive $4 \times 3 = 12$ points for that letter. Any engagement in conflict (E/C) may be entered in the "Marker E/C'd" line 102 of scoresheet 96 by noting the classification of the opposing marker (infantry: I, special forces: SF) and of course entering the appropriate total score for that letter in the appropriate space in the points row 104 of scoresheet 96, in accordance with step 3 of FIG. 5.

It is important to note that no capturing or removal of any of the game pieces occurs during the play of the present game. While two (but no more than two) pieces or makers may occupy or "engage in conflict" on a single square of the board 10, the subsequent occupation of a square by a second opposing marker does not cause the first marker to be removed. Rather, both players keep all markers or pieces with which they started the game, in play throughout the game. The markers are stacked one atop the other or laterally interfit with one another when engagement in conflict occurs, as described above, in order to save board space.

As an example of the play of the present game described above, let us assume a simplified version of the present game in which only one side moves in order to more clearly show the steps and scoring involved. Of course, in the play of an actual game, opposing sides would alternate turns and might attempt to block one another as the development of a word became obvious. Moreover, let us assume that a first player is attempting to form the word, "GENE."

By visualizing the placement of the various playing pieces in their starting positions, as shown in FIG. 3, in combination with the lettered board 10 shown in FIG. 2, a first move to place a marker on a letter "G" of the board 10 may be seen. This will prove to be the most difficult letter to secure in a single move from the starting position, as there are only four "G"'s on the board 10 of the preferred embodiment, located on squares 14/48, 22/50, 26/50, and 34/52. It will be noted that the "G" squares at 14/48 and 34/52 cannot be reached in a single legal move by any of the first player's markers from their starting positions on rows 26, 28 and 30 of board 10. Further, the letter "G" of square 26/50 is already occupied by a first player's infantry marker 72, so cannot be used by the first player until that marker is moved and that or another first player's marker is moved to that square.

However, the "G" of square 22/50 will be seen to be accessible by the cavalry marker 80 starting from square 28/44 and moving forward or upward generally toward the upper or top edge 64 of board 10 and diagonally to the right. Further, the "G" square 22/50 is already occupied by an opposing infantry marker 72, which means that double points will accrue due to the resulting engagement in conflict which will occur when the first player's cavalry marker 80 also occupies square 22/50 to claim the letter G. The first player's cavalry marker 80 is stacked atop the second player's infantry marker 72 on square 22/50 and the resulting letter "G" is entered in the appropriate space on scoresheet 96, with the score (first letter of the word = 1 point, $\times 2$ for the engagement in conflict with an opposing infantry marker) entered in the appropriate "points" space 108 of scoresheet 96. The letter "I" is also entered in the appropriate space 110 in the "marker E/C'd" row, to indicate the reason for the doubling of the score for this first letter. (Had the engagement been with an opposing special forces marker 80, 84, 88 or 92, the score would have been tripled and the notation "SF" entered in space 110, as discussed further above.)

As noted above, at this point the opposing player/-team would make his/her first move. However, in the interest of simplicity, a second move by the first player/team will be described. The next letter to be secured will be an "E." (Letters must be acquired in the order used to form the word.) An examination of the board 10 of FIG. 2 shows the letter "E" to occur more frequently than any other (13 squares), just as in the case of the English language. Thus, any one of several of the first player's markers may be moved to acquire an "E." Perhaps a good strategy to use at this point would be to advance the first player's paratrooper marker 84 from its starting square 28/46 two spaces forward and diagonally to the right, to the "E" square of 24/50, thus claiming an "E." The paratrooper markers 84 of both sides may jump or pass over any other single markers either of their own or of the opposition, so long as they do not cross over a square containing two markers (engaging in conflict). This marker will be in a good position to engage in conflict with the opposing paratrooper or cavalry markers of squares 20/46 or 20/54 in the event a letter "T" is needed later, thus offering the potential of tripled points due to their special forces status. The "E" secured is entered in the second letter space 112 and the 2 points (for the second letter of the word) are entered in the appropriate space 114 of score sheet 96, as shown in FIG. 4.

The next letter needed is an "N." Several possibilities are available, e.g. by means of lateral movement of the "general" marker of square 30/50 to either square 30/42 or 30/58, or by advancing either of the infantry markers of squares 26/48 and 26/52. Other moves are possible also. Let us advance the infantry marker 72 of square 26/52 forward to the "N" square of 24/52, in order to keep the left rear diagonal open for the cavalry marker 80 which was earlier advanced to the "G" square 22/50 to start the word. The "N" acquired is entered in the appropriate third letter space 116 of scoresheet 96 and the three points (for the third letter) entered in space 118, as shown in FIG. 4.

The last letter needed is another "E." In the course of an actual game, it is likely that the opposing player would have advanced one or more of his/her markers to an "E" square, thus raising the possibility of a further engagement in conflict and the doubling or tripling of points for that letter. In this example, none of the opposition pieces have been moved from their starting positions, and thus none occupy an "E" square. In any case, several possibilities exist, such as the advancement forward and diagonally to the left of the cavalry marker 80 engaged in conflict on square 22/50 to the "E" square 18/46. The resulting letter "E" is entered in the fourth letter space 120 of scoresheet 96 and the four points accrued are entered in the fourth points space 122.

The points resulting from the formation of the above word "GENE" are then added up and entered in the word score space 124 for the first row 100 of scoresheet 96, resulting in a score of 11 for the formation of the word. However, the astute player will recognize that "GENE" is not only a complete word, but that it also serves as the root of longer words, such as "GENETIC" or "GENERAL". Accordingly, a player may not wish to stop with 11 points, but to continue to form a longer word for a higher score. As each subsequent letter is arithmetically increased in value, the longer a word is, the more desirable it is. However, in accordance with the preferred rules, standard pluralization is not allowed, thus ruling out the mere addition of an "S" to form the word "GENES" is not permitted. Moreover, proper nouns are not allowed (unless, as in the above example, they are also a common noun), nor are non-English, abbreviated, or hyphenated words, and spelling errors are heavily penalized by the disallowance of any points for that word and an additional 25 point penalty. Words must be at least two letters in length, and once a word has been used in a game, it may not be used again. (In the case of the above example, if the player forming the word "GENE" continued to form a longer word based upon those initial four letters, the letters "GENE" would not be considered to have formed a separate word. Thus, that or another player could form the word "GENE" at a later time during the game if he/she desired.)

Assuming the player wishes to continue to form a longer word, the final score for any shorter word formed to that point would of course not be entered in space 124 of the scoresheet 96. Rather, the player would continue to play in turn, adding letters as able according to the above rules. For example, the player may wish to continue to form the word "GENETIC" by advancing the paratrooper marker 84 presently on square 24/50, forward and diagonally to the right to the "T" square 20/54 occupied by one of the opponent's cavalry markers 80. Again, a paratrooper marker 84 may jump over any other singly occupied squares. As the "T" square 20/54 is occupied by an opposing special forces class of marker, the normal five points resulting from the acquisition of this fifth letter will be tripled to fifteen points.

In accordance with the above rules, various moves may be seen permitting the acquisition of the remaining letters "I" and "C," such as the laterally leftward movement of the general marker 92 of square 30/50 to the "I" square 30/40, and the laterally leftward movement of the paratrooper marker 84 currently engaged in conflict on square 20/54 to the "C" square 20/50. Scoring is accomplished in accordance with the above described rules.

While plurals are preferably not accepted, there is no such rule against adverbs in the preferred embodiment of the present game. Hence, the first player could continue to expand the word "GENETIC" to form "GENETICALLY," if he/she desired. A possible sequence of moves would be to move the scout marker 88 situated on square 28/42, laterally leftward one space to the adjacent "A" square 28/40 to claim that letter, and further to unblock the diagonal the marker was previously resting upon; move the infantry marker 72 previously advanced to the "N" square 24/52 rearward to its original starting position on the "L" square 26/52 to claim the first "L;" advance the general marker 92 from the previously claimed "I" square 30/40 forward and to the right along the now open diagonal, to claim the second "L" and engage in conflict with the opponent's infantry marker 72 on the "L" square 22/48, whereupon the general marker 92 would be stacked atop the infantry marker 72 already on that square; and finally to move the cavalry marker 80 previously moved to the "E" square 18/46 to claim that letter, downward and diagonally leftward to engage in conflict with the opposing paratrooper marker 80 on the "Y" square 20/44. Scoring is accomplished in accordance with the above described rules. However, it should be noted that the above sequence of moves provided for the doubling and tripling of the score for the last two letters used to form the word "GENETICALLY." This is a desirable strategy, as the later in the word a letter occurs, the more valuable that letter is. In the case of the above examples, the penultimate or tenth letter comprising the second "L" would ordinarily be worth ten points. However, due to the engagement in conflict with an opposing infantry marker 72, the score for that letter was doubled. Similarly, the last or eleventh letter, "Y," resulted in a score of 33 points for that letter alone due to the tripling of the standard eleven points by means of the engagement in conflict with an opposing cavalry (special forces) marker 80.

It will be appreciated that the above example of the formation of the word "GENETICALLY" is greatly simplified, due to the intentional lack of inclusion of any alternating moves by the opposition in order to simplify the explanation of the present game. If such were occurring, it is likely that the opponent, upon recognizing the development of a given word, would analyze the situation and move one or more of his/her pieces defensively in order to preclude the awarding of relatively high scores due to engagement in conflict. The rules of the present game allow for this, by allowing a player to skip or otherwise fail to acquire a letter for the formation of a word for up to two consecutive turns. (This rule may be modified by allowing only one skip after a specific number of letters, e.g. five, have been acquired toward the formation of a word, or possibly not allowing any skips or passes without losing the letters thus acquired for the formation of a word.) Modifications may be made, such as limiting the time allowance for each move by each player; allowing more time per move for less experienced or less skillful players; allowing less skilled players to skip or pass more turns before acquiring a letter in the formation of a word; etc. While the basic rules for the above game are relatively simple, it will be seen that the strategy and tactics resulting from other rules such as the provision for engaging in conflict can be extremely involved, thus providing a novel game of considerable and lasting interest to players of virtually all ages, skill levels and abilities.

It is to be understood that the present invention is not limited to the sole embodiments described above, but encompasses any and all embodiments within the scope of the following claims.

I claim:

1. A method of playing a board game involving the formation of words by means of moving player position markers upon a lettered game board, said method comprising the following steps:

providing a game board including a rectangular matrix of lettered spaces;

further providing a first group and a second group of player position markers, with the player position markers of the first group having a different color than the player position markers of the second group to provide for differentiation by a first player and a second player, and with each group of player position markers comprising a plurality of different types of player position markers with each of the different types of player position markers having a different shape and form to designate a specific pattern of movement of each of the types of player position markers, with each group of player position markers having like numbers and kinds of the different types of player position markers; and further providing a scoresheet;

determining a first player and placing the first and second groups of player position markers upon the board in a starting array with the first group of player position markers opposite the second group of player position markers;

each player trying to form a word by alternatingly moving player position markers of the first and second groups respectively by first and second players to lettered spaces on the game board, and continuing in accordance with one of the four following steps;

step 1) using a letter of space to which a player position marker has been moved, in the forming of a word;

step 2) passing a turn and thereby avoiding the selecting and using of a letter of one of the lettered spaces of the game board;

step 3) moving a player position marker to a lettered space of the game board and choosing not to use the letter of the lettered space to which the player position marker was moved;

step 4) engaging in conflict by placing a player position marker of one group on a lettered space occupied by a player position marker of the other group;

a player, in trying to form a word entering on the scoresheet the letter of the lettered space to which a player position marker was moved, and further entering a point value on the scoresheet depending upon the position of the letter in the word being formed and the engagement in conflict status of the player position marker;

continuing in accordance with the above steps until the end of the game is reached; and determining the winner of the game as the player having the highest total number of points.

2. The method of playing a board game according to claim 1 including:

providing a point value for each letter entered on the scoresheet according to the sequential position of each letter in the word being formed, with the point value for each letter increasing in arithmetical progression from the first letter through all subsequent letters and the last letter of the word being formed.

3. The method of playing a board game according to claim 1 including:

determining the end of the game by reaching a predetermined number of points.

4. The method of playing a board game according to claim 1 including:

determining the end of the game by the elapsing of a predetermined period of time.

5. The method of playing a board game according to claim 1 including:

providing a game board having a matrix of thirteen by thirteen lettered spaces including a total of 169 lettered spaces.

6. The method of playing a board game according to claim 1 including:

providing different types of player position markers with each group comprising like types, and each of the different types being permitted different movement on the game board.

7. The method of playing a board game according to claim 6 including:

providing infantry player position markers in each group, with the infantry player position markers being permitted forward and rearward moves to an adjacent space and diagonal moves to an adjacent space occupied by a player position marker of the other group; and providing four additional different types of special forces player position markers in each group, with the special forces player position markers being permitted moves over a plurality of spaces.

8. The method of playing a board game according to claim 7 including:

providing scout special forces player position markers being permitted forward, rearward, and left and right lateral moves over a plurality of spaces;

providing cavalry special forces player position markers being permitted diagonal moves over a plurality of spaces;

providing paratrooper special forces player position markers being permitted forward, rearward, left and right lateral, and diagonal moves over two spaces; and providing general special forces player position markers being permitted forward, rearward, left and right lateral, and diagonal moves over a plurality of spaces.

9. The method of playing a board game according to claim 8 including:

providing a plurality of vertical extensions in a lateral array on at least one type of special forces player position marker and further providing cooperating vertical slots in at least one other type of special forces player position marker.

10. The method of playing a board game according to claim 7 including:

providing at least one type of special forces player position marker with means allowing for lateral interfit with at least one other type of special forces player position marker.

11. The method of playing a board game according to claim 7 including:

doubling the point value of a letter entered on the scoresheet and used in the forming of a word when entered as a result of an engagement in conflict between a player position marker of one group and an opposing infantry player position marker.

12. The method of playing a board game according to claim 7 including:

tripling the point value of a letter entered on the scoresheet and used in the forming of a word when entered as a result of an engagement in conflict between a player position marker of one group and an opposing special forces player position marker.

* * * * *